US005183518A

United States Patent [19]

Radon

[11] Patent Number: 5,183,518

[45] Date of Patent: Feb. 2, 1993

[54] CRYOGENICALLY SUPER-HARDENED HIGH-CHROMIUM WHITE CAST IRON AND METHOD THEREOF

[75] Inventor: Roman Radon, Belleview, Fla.

[73] Assignee: Townley Foundry & Machine Co., Inc., Candler, Fla.

[21] Appl. No.: 830,464

[22] Filed: Feb. 6, 1992

Related U.S. Application Data

[63] Continuation of Ser. No. 658,351, Feb. 22, 1991, abandoned, which is a continuation-in-part of Ser. No. 345,696, May 1, 1989, abandoned.

[51] Int. Cl.[5] ..... C21D 5/04; C22C 38/36

[52] U.S. Cl. ..... 148/324; 148/545; 148/612

[58] Field of Search ..... 148/545, 612, 323, 324; 420/16, 11

[56] References Cited

U.S. PATENT DOCUMENTS 3,410,682 11/1968 Avery et al. ..... 420/16
3,690,958 9/1972 Thompson ..... 148/545
3,784,416 1/1974 Davies ..... 148/545
4,382,828 5/1983 Henych ..... 148/545
4,395,284 7/1983 Dawson ..... 148/323

FOREIGN PATENT DOCUMENTS 54-104425 8/1979 Japan .
56-47545 4/1981 Japan .

*Primary Examiner*—Deborah Yee
*Attorney, Agent, or Firm*—Pollock, Vande Sande & Priddy

[57] ABSTRACT

A highly abrasion-resistant, high-chromium white cast iron alloy containing the following elemental analysis in percent by weight: 2.4–3.8% carbon, 0.4 to 2.0% manganese, 0.2 to 1.9% silicon, 0.0 to 3.0% copper, 1.5 to 4.5% nickel, 12.0 to 29.0% chromium, and the remainder iron; and super-hardened by placement in a cooling medium at a temperature of at least −55° C. for a time sufficient to cause the iron alloy to have a hardness of at least about 700 HB.

22 Claims, No Drawings

CRYOGENICALLY SUPER-HARDENED HIGH-CHROMIUM WHITE CAST IRON AND METHOD THEREOF

RELATED APPLICATIONS

This is a continuation of application Ser. No. 07/658,351 filed Feb. 22, 1991, which is a continuation-in-part of Ser. No. 07/345,696 filed May 1, 1989, both now abandoned, the entire contents of these applications which are incorporated herein by reference.

TECHNICAL FIELD

The present invention relates to white cast iron, and more particularly to a hardened high-chromium white cast iron alloy and a process for making the same.

BACKGROUND OF THE INVENTION

High-chromium (at least 12% by weight) white cast iron is well known for its high resistance to abrasion. There are several different types of abrasion. Each has a unique way of attacking the surface exposed to it.

One is erosive abrasion, in which minute, hard, mainly mineral particles strike the casting surface at varying velocities and angles ranging from 0°-90°. Slurry pump parts, parts of earth moving equipment, slurry classifier shoes, log washer teeth and chute liners are just some of the castings subjected to erosive abrasion.

Another type of abrasion is one where the abrasive strikes the casting surface with enough force to tear out metal particles. This is a process accompanied by high dynamic loads. Crushing machine jaws, hammer mills, working parts of dredges and plungers are among the castings subjected to this type of abrasion.

Another wear-inducing type of abrasion can be found where the abrasive is being crushed, or pulverized between two moving, working surfaces. Here the abrasive penetrates the casting surface with a significant perpendicular force. This type of wear is found in pulverizer ball mills, plate crushers, roll mills, and the like.

In the above-mentioned wear conditions, the parts of the machines subject to wear are most often made of high-chromium white cast iron having eutectic metal carbides ($M_xC_y$) precipitated in a very hard, durable, and at the same time, tough matrix.

Hardness is the one mechanical property of high-chromium white cast iron which the individual users as well as the manufacturers look for and examine most closely, although other (non-standard) tests to determine strength, impact resistance and fracture toughness are sometimes employed as well.

It is well known that castings of high-chromium white cast iron possess good resistance to the many types of abrasion to which such castings are subjected. This abrasion resistance is achieved during solidification of the casting by precipitation of eutectic carbides of great hardness in a matrix which should also be hard and durable. The carbides and the matrix act essentially independently of each other.

At the present time, high-chromium white cast irons are further hardened through some type of high temperature heat treatment process. By far the most widely used and proven method involves heating the castings up to 900° C.-1060° C. and holding them there for 1-4 hours, depending on chemical considerations of different compositions. This temperature is recommended for precipitation of secondary carbide particles in the austenite in very high density. The precipitation lowers the amount of carbon dissolved in the austenite and raises the $M_s$ temperature. This permits transformation of substantial amounts of austenite to martensite during cooling to room temperature. Usually air quenching is used. Following the air quenching, it is advisable to stress-relieve the castings at 200° C.-260° C. In this process, the matrix contains strongly precipitated secondary carbides in very high density, which is the reason for its brittleness. The large temperature gradients involved in these processes also has a negative effect on the toughness of the castings.

Another method of hardening high-chromium white cast iron is a subcritical heat treatment, consisting of maintaining the casting at 450° C.-600° C. for 6-12 hours. This type of hardening has as its goal the reduction of retained austenite by transforming it into the harder ferrite-carbide phase. The amount of austenite that will transform depends largely on the composition and the prior cooling rate of the casting while in the mold. This low temperature transformation of austenite is, therefore, not feasible except for very slowly cooled castings. Usually, high chromium-molybdenum alloy irons, which are cast in thicknesses which cool quickly in the mold, do not allow sufficient precipitation of secondary carbides and as a result have as much as, or more than, 50% austenite in the matrix structure. The transformation of this austenite by subcritical heat treatment is very difficult because of the super-saturation of the matrix with carbon and alloying elements. This type of hardening is also associated with the precipitation of ferritic secondary carbides which reduce the durability of the matrix. In addition, this type of hardening causes excessive tempering of the preliminary martensite, lowering its hardness and its abrasion resistance. No one has exceeded 650-680HB with this method.

High-chrome molybdenum white cast irons, which undergo high temperature (900° C.-1060° C.) or subcritical (450° C.-600° C.) heat treatments, gain in abrasion resistance due to the hardening of the matrix. Castings which have complicated shapes and varying section thicknesses are used as-cast, without heat treating, because of the danger of cracking due to the thermal stresses developed during the treatment. The as-cast hardness of the castings 450-500 HB) is low, and the abrasion resistance is also lowered. Castings with large section thicknesses and large masses, such as those used in crushers, pulverizers and steel mill rollers, when made of high-chromium-molybdenum white iron having some nickel in the composition and subjected to a high temperature heat treatment, have a martensitic-austenitic-bainitic matrix. The bainite is present in the matrix because castings of such large section thicknesses cannot be cooled fast enough, due to the large temperature difference between the casting surface and center and also due to the accompanying high thermal stress. However, an increased addition of nickel increases the amount of retained austenite, which simultaneously lowers the hardness and increases the likelihood of failure due to abrasion and spalling. High-chromium molybdenum white cast iron having additional nickel or copper, and properly cooled in the mold, almost always has a martensitic-bainitic structure, with some perlite and retained austenite. Chrome-molybdenum-nickel irons designed for high temperature heat-treatment, usually contain a limited amount of nickel and copper, usually totalling together a maximum 1.5%, due to the strong stabilization of austenite and its retention in the matrix in the form of the so-called "retained austenite".

High-chromium white irons hardened through high temperature heat treatment contain molybdenum as the chief perlite-suppressing (hardenability-increasing) alloying element. Molybdenum, a potent carbide-former as well as a ferrite-former, is tied up in carbides to a major extent. Molybdenum has a moderate influence in retarding the transformation of austenite to perlite in the range of the $A_{c1}$ temperature (subcritical) and the $M_s$ temperature (beginning of martensitic transformation). However, it has no influence on the bainitic transformation.

High-chromium-molybdenum white irons, when heat treated at temperatures of 900° C.–1060° C. and then cooled by air quenching at a rate greater than the critical cooling rate, become hardened. The matrix attains a martensitic structure with retained austenite, which is super-saturated with carbon. Castings made of high-chromium-molybdenum and high chromium-molybdenum-nickel white iron, cooled in sand molds, contain martensitic-bainitic structure, or after fast cooling, martensitic structure with large amounts of retained austenite, which are super saturated with carbon. The transformation of super-saturated retained austenite to martensite by sub-critical heat treatment is very difficult.

OBJECTS OF THE INVENTION

It is a principal object of the present invention to provide a hard high-chromium white cast iron alloy which is obtained without a high temperature heat treatment, and which is highly responsive to cryogenic super-hardening.

It is a further object of the present invention to provide a super-hardened high-chromium white cast iron alloy possessing markedly improved resistance to abrasion and a Brinell hardness of at least 700.

It is also an object of the present invention to provide a high-chromium white cast iron alloy which is not only very hard and highly abrasion resistant, but also is more durable and at the same time has a tough matrix, all made possible by cryogenic hardening without a prior heat treatment sufficient to cause the precipitation of secondary carbides, the main cause of matrix brittleness.

It is another object of the present invention to provide a high-chromium white cast iron alloy which has a markedly improved fracture resistance due to the lower thermal stresses connected with the cryogenic hardening treatment in which the temperature gradient is much lower (+20° C. to −100° C.) than in high temperature heat treating (+20° C. to +1060° C.).

It is also an object of the present invention to provide a high-chromium white cast iron alloy, which makes possible the super-hardening of castings with complicated shapes, as well as those with great mass and section thicknesses, by avoiding the serious problems presented by subjecting such castings to high temperature heat treating processes. This is possible due to the predominantly low carbon and the presence of a substantial amount of nickel, and is facilitated by the presence of copper, in the retained austenite structure which is easily transformed to low carbon martensite by the cryogenic treatment.

A further object of this invention is to provide an inexpensive, quick and uncomplicated process for providing super-hardened high-chromium white cast iron alloys.

Another object of this invention is to provide a process for super-hardening a unique high-chromium white cast iron wherein existing high temperature heat treating furnaces can be easily and cheaply adapted to the cryogenic step of the process, while remaining fully usable a well for high temperature heat treatments of other cast irons.

It is also an object of this invention to provide a high-chromium white cast iron alloy for producing castings which resist spalling and scaling, such as normally caused by constant abrasion combined with repeated impact. This is made possible through drastic reduction of retained austenite in the matrix.

It is also an object of this invention to virtually eliminate the scrapping of castings due to thermal stress defects, such as cracking and warping, so common in the traditional high temperature heat treating processes. The cryogenic hardening treatment of the invention causes no substantial thermal stresses in the castings and, consequently, the scrapping of castings due to thermal stress defects is virtually eliminated.

Still another object of the invention is to provide a hardening treatment for a finished iron casting which involves thrusting the casting while at room temperature into a cooling medium maintained at a temperature in the range of −196° C. to −55° C., and keeping it there until the hardness of the casting has increased to at least 700 HB.

Yet another object of this invention is to provide white iron castings which attain increased abrasion resistance, with a simultaneous increase in matrix durability, due to the absence in the matrix of the precipitated, brittle secondary carbides found in all high temperature heat treated white cast irons. The super-hardened white iron castings of the invention possess an excellent combination of great hardness and toughness, and much better fracture resistance than white iron castings hardened with any form of high temperature heat treating, or a combination of high temperature heat treating and cryogenic treating.

Other objects will appear from the more detailed description of this invention which follows.

SUMMARY OF THE INVENTION

This invention provides a process for making abrasion resistant castings of high-chromium white cast iron alloys, which comprises the steps of:

(1) preparing a molten metal composition having the following elemental analysis in percent by weight of the total: carbon 2.4–3.8; manganese 0.4–2.0; silicon 0.2–1.9; copper 0.0–3.0: nickel 1.5–4.5; chromium 12.0–29.0; and the remainder being iron;

(2) pouring the molten metal composition into a mold to produce a casting and allowing the casting to cool to room temperature; and, (3) placing the room temperature casting in a cryogenic cooling medium at a temperature of at least about −55° C. for a time sufficient to cause the casting to have a hardness of at least 700 HB (Hardness as determined by the Brinell test).

The cooling of step (3) above is carried out without prior heating of the room temperature casting sufficient to cause precipitation of secondary carbides in the matrix of the casting. The casting may be finished by grinding or the like to provide at least one smooth surface thereon, preferably before the cryogenic cooling of step (3). The invention also provides a high-chromium white cast iron alloy having the above composition.

DETAILED DESCRIPTION OF THE INVENTION

The present invention provides a unique white cast iron alloy. In addition to iron, the alloy has the following elements in its composition: 2.4 to 3.8% carbon, 0.4 to 2.0% manganese, 0.2 to 1.9% silicon, 0.0 to 3.0% copper, 1.5 to 4.5% nickel, 12.0 to 29.0% chromium. This composition has an excellent resistance to abrasion and is very hard. The composition also is highly responsive to a cryogenic hardening process, thereby becoming super-hard. When hardened by the cryogenic treatment, the composition possesses higher abrasion resistance, greater hardness, and a durable matrix without the usual precipitation of secondary carbides.

Nickel, copper and manganese when used as iron alloying elements significantly widen the field of austenite and shift the range of existence and duration of homogeneous austenite to lower temperatures (below 200° C.). Below 200° C. any diffusive transformation such as perlitic and bainitic is arrested. The only transformation that takes place is the diffusionless martensitic transformation. Nickel and copper significantly lower the $M_s$ temperature, whereas the $M_f$ temperature always remains a sub-zero temperature.

In the treatment process of the present invention, high-chromium white cast iron with additions of nickel and copper, which are almost entirely distributed in the austenitic phase or its transformation products, when subjected to sub-zero treatment of at least −55° C., preferably −75° C. to −100° C., attain much greater hardening than that achieved through conventional high temperature treatments. In the process of the present invention, the low carbon martensite produced in the high chromium irons alloyed with nickel and copper is desirable for its intrinsic toughness and hardness because of the absence of auto-tempered martensite.

In the present invention, the main alloying elements used to increase hardenability (perlite-suppressing) of the high-chromium white cast irons are nickel, copper and manganese. These alloying elements, nickel, copper and manganese, strongly stabilize the austenite phase, while greatly widening the field of the austenite. The element nickel, while widening the field of the austenite phase to lower temperatures, at the same time, under conditions of ambient cooling in the mold and in the absence of molybdenum, completely eliminates bainite reactions. Nickel is almost entirely distributed in the austenite phase or its transformation products. Nickel is needed in somewhat larger amounts (about 1.5% to about 4.5%) to completely suppress perlite formation, thereby ensuring that a martensitic composition with some retained austenite results when the castings cool in their molds. Nickel, copper and manganese significantly lower the temperatures $M_s$ and $M_f$ of high-chromium white irons.

High-chromium white cast irons containing nickel or copper elements should be chosen in such a way that the $M_s$ temperature is below 150° C., to keep the preliminary martensite from auto-tempering, regardless of the cooling rate. The hardness of the martensite obtained this way is significantly higher than that of auto-tempered martensite. Strong pearlite suppression and lowering the $M_s$ temperature below 200° C. by using the alloying elements nickel, copper, and manganese also arrests any diffusive transformation such as perlitic and bainitic. The only transformation that takes place below 200° C. is the diffusionless martensitic transformation.

In the present invention, it has been found that high-chromium white cast irons alloyed with about 1.5% or more of nickel and cooled in the mold, produce martensitic structures with low carbon retained austenite, which is easily transformed by the cryogenic treatment of this invention into low carbon martensite with its intrinsic toughness. It also has been found that copper may be substituted for part of the nickel, and that this is preferable because it provides a synergistic effect which increases the as-cast hardness. Accordingly, the high-chromium white cast iron of the present invention is alloyed with sufficient nickel, or sufficient nickel and copper, to provide a hardness in the range of 512 HB to 650 HB as cast. After cryogenic hardening (such as at −100° C. for 1 hour), a super-hardness of at least 700 HB, preferably 720 HB–857 HB is attained.

The white cast iron compositions of the present invention contain no significant molybdenum and are hardened by ambient cooling in a mold to about room temperature (20 to 40° C.), followed by super-cooling to cryogenic temperatures (at least about −55° C.) without any prior heat treatment that causes precipitation of secondary carbides. In comparison, the presence of molybdenum in white cast irons produces remarkedly different properties in the hardening of such irons; namely, such irons containing molybdenum must be hardened by a high temperature heat treatment which precipitates secondary carbides, and this may be followed by a low temperature cooling treatment.

Those persons skilled in the art can readily recognize the important advantages resulting from the cryogenic hardening of the high-chromium white irons of the present invention. First, the great hardness of the castings is achieved without the precipitation of secondary carbides in the matrix, and second, the outstanding toughness of the castings is due to the absence of thermal stresses, such as those which accompany high temperature heat treating processes. Also, the castings of this invention are super-hardened cryogenically, which is the least time-consuming, the least expensive, the simplest and the least scrap-producing hardening process known at the present time.

Small castings (2 kg–40 kg) of simple shapes can be hardened very quickly (in 5 to 8 minutes) by submersion in liquid nitrogen (about −196° C.), without producing cracks and with the production of hardnesses ranging from 720 HB to 857 HB.

Within the broad range of the composition of the white iron alloys of this invention as described above, the following are five preferred compositions for different use applications (all percentages being by weight of the total and the balance consisting essentially of iron):

(a) 2.4 to 3.3% carbon, 0.4 to 1% manganese, 0.2 to 0.6% silicon, 1 to 2.5% copper, 1 to 2.5% nickel, 23 to 29% chrome;

(b) 3 to 3.6% carbon, 0.4 to 1.2% manganese, 0.4 to 1.4% silicon, 1 to 2.5% copper, 1.5 to 2.5% nickel, 16 to 22% chrome;

(c) 3.2 to 3.8% carbon, 0.8 to 2% manganese, 0.8 to 1.9% silicon, 1.0 to 3% copper, 2.5 to 4.5% nickel, 12 to 15% chrome.

(d) 2.4 to 3.3% carbon, 0.4 to 1% manganese, 0.2 to 0.6% silicon, 1 to 3.0% copper, 1.5 to 3.2% nickel, 21.5 to 29% chrome; and, (e) 3 to 3.6% carbon, 0.4 to 1.2% manganese, 0.2 to 1.6% silicon, 1 to 3.0% copper, 2.5 to 3.2% nickel, 13.8 to 18.5% chrome.

The content of nickel and copper is dictated by the section thickness of the casting. In castings having section thicknesses of 10–25 mm, the nickel, copper, and manganese content should be lower, while in castings with section thicknesses of 250–300 mm, the nickel, copper, and manganese content should be higher.

The process of this invention involves preparing a molten metal mass, pouring castings therefrom, cooling of the castings, and subjecting the castings to a cryogenic cooling treatment to produce the desired hardness. The surface of the casting may be cleaned and finished, either before or after cryogenic cooling. In detail, the preferred process involves the following steps:

(1) mixing the necessary components to be fed to the furnace;

(2) melting the mixture in the furnace to a pouring condition;

(3) pouring the molten metal composition into an appropriate mold;

(4) letting the mold and the casting therein cool slowly to room temperature under ambient conditions;

(5) cleaning and finishing the surface of the casting, as by grinding or the like to smooth the surface; and, (6) immersing the finished casting in a cryogenic cooling medium at a temperature of −196° C. to −55° C. for a time sufficient to reach a hardness of at least about 700 HB.

The principal features of this process include the chemical composition of the cast iron and the cryogenic treatment to produce the desired high hardness and great toughness. The different chemical compositions that may be used are presented above. The cryogenic treatment may be accomplished by submerging the casting in liquefied air, in liquid nitrogen (appx. −196° C.), in another inert liquefied gas, or in any other low temperature (at least −55° C.) cooling medium or environment. The time of the cryogenic treatment may vary for different compositions, but preferably is not less than about 30 minutes or more than about one hour, or until the hardness has increased to at least 700 HB.

EXAMPLES

The following examples are illustrative of the process and composition of this invention. Parts and percentages are by weight and temperatures in degrees centigrade unless otherwise specified.

Several experimental cast iron alloy compositions were melted in induction furnaces of 450 kg. and 1360 kg. capacity and poured into no-bake furan sand molds and into graphite forms. The metal from melt #1 was poured into no-bake furan sand molds to obtain the following castings: A pump impeller having a wall thickness of 45 mm to 89 mm and a weight of 445 kg, and other castings with thicknesses of 25 mm to 57 mm and weights of 14 kg to 20 kg. The as-cast hardnesses were from 532 HB to 600 HB. After subjecting the above castings to cryogenic hardening at a temperature of −100° C. for 45–60 minutes, the hardnesses were 713 HB to 744 HB. The castings from graphite forms had hardnesses of 817 HB to 857 HB after cryogenic hardening. The same castings were prepared by pouring metal from melt #2 into no-bake furan sand molds and had as-cast hardnesses of 555 HB to 627 HB, and hardnesses of 744 HB to 788 HB after cryogenic hardening.

The metal from melt #3 was cast into the following items: A suction pump liner having wall thicknesses of 20 mm to 108 mm and weighing 432 kg, a pump impeller with thicknesses of 45 mm to 100 mm and weight of 636 kg, and a series of smaller items of thicknesses of 20 mm to 63 mm and weights of 12 kg to 24 kg. The as-cast hardnesses were 532 HB to 627 HB. After cryogenic hardening, the hardnesses became 744 HB to 782 HB. The same castings were prepared from the metal of melt #4. As cast, they had hardnesses of 555 HB to 627 HB. After cryogenic hardening, the hardnesses became 744 HB to 782 HB. The metal from melt #5 was cast into items having thicknesses of 25 mm to 75 mm and weights of 9 kg to 27 kg. Castings from no-bake furan sand molds had hardnesses ranging from 532 HB to 600 HB. Castings from graphite molds had hardnesses from 512 HB to 572 HB. After cryogenic hardening, the sand mold castings had hardnesses of 744 HB to 817 HB, while the graphite mold castings had hardnesses of 782 HB to 817 HB. These experiments are summarized in Table 1.

The above experiments clearly demonstrate that high-chromium white cast irons of the above compositions in the as-cast state have martensitic structures and low carbon in the retained austenitic regions, and are very responsive to transformation through cryogenic treatment to low carbon martensite with intrinsic toughness.

Furthermore, the matrices of the cast irons of the present invention after cryogenic treatment are composed of martensite without precipitated secondary carbides. The castings made of the above described irons, after cryogenic hardening, have the best combination of hardness and toughness, because their matrices do not contain secondary carbides and because the cryogenic treatment process creates almost no thermal stress.

While the invention has been described with respect to certain specific embodiments, it will be appreciated that many modifications and changes may be made by those skilled in the art without departing from the spirit of the invention. It is intended, therefore, for the appended claims to cover all such modifications and changes as fall within the true spirit and scope of the invention.

TABLE I

| CAST IRON # ELEMENTAL ANALYSIS IN WEIGHT % | | | | | | |
|---|---|---|---|---|---|---|
| MELT NO. | C | Mn | Si | Cu | Ni | Cr |
| 1* | 2.8 | 0.6 | 0.4 | 1.9 | 1.5 | 25.8 |
| 2* | 3.2 | 0.7 | 0.6 | 2.0 | 1.8 | 21.5 |
| 3** | 3.3 | 0.8 | 0.8 | 2.2 | 2.2 | 18.5 |
| 4** | 3.4 | 0.8 | 1.6 | 2.5 | 3.2 | 13.8 |
| 5*** | 3.48 | 1.3 | 1.8 | 2.6 | 2.8 | 12.9 |

| HARDNESS IN HB | | | | |
|---|---|---|---|---|
| | NO-BAKE FURAN SAND MOLD | | GRAPHITE FORM | |
| MELT NO. | AS-CAST | AFTER CRYOGENIC TREATMENT | AS-CAST | AFTER CRYOGENIC TREATMENT |
| 1* | 532–600 | 713–744 | — | 817–857 |
| 2* | 555–627 | 744–788 | — | — |
| 3** | 532–627 | 744–782 | — | — |
| 4** | 555–627 | 744–782 | — | — |
| 5*** | 532–600 | 744–817 | 512–572 | 782–817 |

Notes:
*Castings 45–89 mm thick weighing 445 kg and castings 25–57 mm thick weighing 14–20 kg.
**Castings 20–108 mm thick weighing 432 kg; castings 45–100 mm thick weighing 636 kg; and castings 20–63 mm thick weighing 12–24 kg.
***Castings 25–75 mm thick weighing 9–27 kg.
Remainder of each cast iron melt is iron.

What is claimed is:

1. A process for making a high-chromium white cast iron alloy, said process comprising the steps of:

(1) preparing a molten metal composition having an elemental analysis in percent by weight of the total consisting essentially of 2.4 to 3.8% carbon, 0.4 to 2.0% manganese, 0.2 to 1.9% silicon, 0.0 to 3.0% copper, 1.5 to 4.5% nickel, 12.0 to 29.0% chromium, and the remainder being iron;

(2) pouring the molten metal composition into a mold to form a casting and cooling the casting to room temperature without precipitation of substantial amounts of secondary carbides in the matrix of the casting; and, (3) placing the room temperature casting in a cooling medium at a cryogenic temperature of about −55° C. or less for a time sufficient to cause the casting to have a hardness of at least about 700 HB, said cryogenic cooling being carried out without prior heating of the room temperature casting sufficient to cause precipitation of substantial amounts of secondary carbides in the matrix of the casting, and said hardened casting having a martensitic matrix which is substantially free of precipitated secondary carbides.

2. A process according to claim 1 wherein the $M_s$ temperature of said molten metal composition is below 150° C.

3. A process according to claim 1 wherein said room temperature casting has a hardness in the range of 512 HB to 650 HB.

4. A process according to claim 1 wherein the time in step (3) is at least 30 minutes.

5. A process according to claim 1 wherein said elemental analysis consists essentially of 2.4 to 3.3% carbon, 0.4 to 1% manganese, 0.2 to 0.6% silicon, 1 to 2.5% copper, 1 to 2.5% nickel, 23 to 29% chromium, and the remainder being iron.

6. A process according to claim 1 wherein said elemental analysis consists essentially of 3 to 3.6% carbon, 0.4 to 1.2% manganese, 0.4 to 1.4% silicon, 1 to 2.5% copper, 1.5 to 2.5% nickel, 16 to 22% chromium, and the remainder being iron.

7. A process according to claim 1 wherein said elemental analysis consists essentially of 3.2 to 3.8% carbon, 0.8 to 2% manganese, 0.8 to 1.9% silicon, 1.0 to 3% copper, 2.5 to 4.5% nickel, 12 to 15% chromium, and the remainder being iron.

8. A process according to claim 1 wherein said elemental analysis consists essentially of 2.4 to 3.3% carbon, 0.4 to 1% manganese, 0.2 to 0.6% silicon, 1 to 3.0% copper, 1.5 to 3.2% nickel, 21.5 to 29% chromium, and the remainder being iron.

9. A process according to claim 1 wherein said elemental analysis consists essentially of 3 to 3.6% carbon, 0.4 to 1.2% manganese, 0.2 to 1.6% silicon, 1 to 3.0% copper, 2.5 to 3.2% nickel, 13.8 to 18.5% chromium, the remainder being iron.

10. A process according to claim 1 wherein the cooling medium of step (3) is a liquefied gas.

11. A process according to claim 1 wherein step (3) comprises submerging the room temperature casting in a liquid cooling medium at a temperature in the range of −55° C. to −196° C. for at least 30 minutes.

12. A process according to claim 2 wherein step (3) comprises submerging the room temperature casting in a liquid cooling medium at a temperature in the range of −55° C. to −196° C. for at least 30 minutes.

13. A process according to claim 3 wherein step (3) comprises submerging the room temperature casting in a liquid cooling medium at a temperature in the range of −55° C. to −196° C. for at least 30 minutes.

14. A process according to claim 5 wherein step (3) comprises submerging the room temperature casting in a liquid cooling medium at a temperature in the range of −55° C. to −196° C. for at least 30 minutes.

15. A process according to claim 6 wherein step (3) comprises submerging the room temperature casting in a liquid cooling medium at a temperature in the range of −55° C. to −196° C. for at least 30 minutes.

16. A process according to claim 7 wherein step (3) comprises submerging the room temperature casting in a liquid cooling medium at a temperature in the range of −55° C. to −196° C. for at least 30 minutes.

17. A process according to claim 8 wherein step (3) comprises submerging the room temperature casting in a liquid cooling medium at a temperature in the range of −55° C. to −196° C. for at least 30 minutes.

18. A process according to claim 9 wherein step (3) comprises submerging the room temperature casting in a liquid cooling medium at a temperature in the range of −55° C. to −196° C. for at least 30 minutes.

19. A process according to claim 1 wherein step (3) comprises thrusting said room temperature casting into a fluid cooling medium at a temperature of −75° C. or less for a time sufficient to increase the hardness of said casting to at least 720 HB.

20. A process according to claim 1 wherein prior to step (3), the room temperature casting is machined by grinding or the like so as to provide the casting with at least one machined surface.

21. A product comprising a high-chromium white cast iron alloy having a hardness of at least about 700 HB and a martensitic matrix which is substantially free of secondary carbides, said alloy having been made by a process comprising the steps of:

(1) preparing a molten metal composition having an elemental analysis in percent by weight of the total consisting essentially of 2.4 to 3.8% carbon, 0.4 to 2.0% manganese, 0.2 to 1.9% silicon, 0.0 to 3.0% copper, 1.5 to 4.5% nickel, 12.0 to 29.0% chromium, and the remainder being iron;

(2) pouring the molten metal composition into a mold to form a casting and cooling the casting to room temperature without precipitation of substantial amounts of secondary carbides in the matrix of the casting; and, (3) placing the room temperature casting in a cooling medium at a cryogenic temperature of about −55° C. or less for a time sufficient to cause the casting to have a hardness of at least about 700 HB, said cryogenic cooling being carried out without prior heating of the room temperature casting sufficient to cause precipitation of substantial amounts of secondary carbides in the matrix of the casting, and said hardened casting having a martensitic matrix which is substantially free of precipitated secondary carbides.

22. A product according to claim 21 wherein prior to step (3) of said process, the room temperature casting is machined by grinding or the like to provide the product with at least one machined surface.

* * * * *